US006836630B2

(12) United States Patent
Owen et al.

(10) Patent No.: US 6,836,630 B2
(45) Date of Patent: Dec. 28, 2004

(54) REDUCTION OF WEAR ON SELECTED COMPONENTS IN MULTI-COLOR IMAGING APPARATUS

(75) Inventors: Kevin Owen, Meridian, ID (US); Jeetendra Kumar, Boise, ID (US); Travis Moats, Nampa, ID (US); Roman Wachter, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 76 days.

(21) Appl. No.: 10/253,690

(22) Filed: Sep. 23, 2002

(65) Prior Publication Data

US 2004/0057752 A1 Mar. 25, 2004

(51) Int. Cl.[7] ..... G03G 21/18

(52) U.S. Cl. ..... 399/112; 399/228; 399/299

(58) Field of Search ..... 399/223, 228, 399/298, 299, 111, 167, 179, 116, 117, 112, 113

(56) References Cited

U.S. PATENT DOCUMENTS

| | | | | |
|---|---|---|---|---|
| 4,860,049 A | | 8/1989 | Toshimitsu et al. | |
| 4,999,680 A | * | 3/1991 | Joseph et al. | 399/119 |
| 5,303,018 A | * | 4/1994 | Terada et al. | 399/299 |
| 5,386,286 A | * | 1/1995 | Kinouchi et al. | 399/228 |
| 5,585,898 A | | 12/1996 | Fujii | |
| 5,740,503 A | | 4/1998 | Nakamura | |
| 5,937,246 A | * | 8/1999 | Kaneyama | 399/228 |
| 5,983,042 A | * | 11/1999 | Nagata et al. | 399/45 |
| 6,032,008 A | | 2/2000 | Kolodziej | |
| 6,188,858 B1 | | 2/2001 | Swapceinski | |
| 6,192,207 B1 | * | 2/2001 | Yamamoto et al. | 399/82 |
| 6,249,663 B1 | | 6/2001 | Alzawa | |
| 6,526,237 B2 | * | 2/2003 | Endo | 399/49 |
| 6,546,218 B2 | * | 4/2003 | Uchida | 399/167 |
| 6,580,523 B1 | * | 6/2003 | Yoshimoto et al. | 358/1.4 |
| 2002/0136568 A1 | | 9/2002 | Hashimoto et al. | |

FOREIGN PATENT DOCUMENTS

| | | | | |
|---|---|---|---|---|
| EP | 0523754 A1 | | 1/1993 | |
| EP | 0467609 B1 | | 2/1996 | |
| GB | 2174930 A | | 11/1986 | |
| JP | 11052658 A | * | 2/1999 | G03G/15/01 |

* cited by examiner

*Primary Examiner*—Robert Beatty

(57) ABSTRACT

A multi-color imaging apparatus that can support a plurality of color-associated rotatable-toner-transfer-devices includes a rotatable-toner-transfer-device disengagement unit. The disengagement unit can selectively disengage a selected color-associated rotatable-toner-transfer-device depending on whether the selected color-associated rotatable-toner-transfer-device is required to generate an image. In one example the imaging apparatus can also include a processor and a computer readable memory device. In this example a rotatable-toner-transfer-device disengage program can be stored in the memory device. The program is executable by the processor to allow the rotatable-toner-transfer-device disengagement unit to selectively disengage the selected color-associated rotatable-toner-transfer-device.

30 Claims, 7 Drawing Sheets

REDUCTION OF WEAR ON SELECTED COMPONENTS IN MULTI-COLOR IMAGING APPARATUS

FIELD OF THE INVENTION

The invention claimed and disclosed herein pertains to multi-color imaging apparatus, and more particularly to methods and apparatus for reducing wear on selected toner distribution components within a multi-color imaging apparatus.

BACKGROUND OF THE INVENTION

Multi-color imaging apparatus are well known in the art. Such imaging apparatus can include printers, photocopiers, and multi-function imaging apparatus. Multi-function imaging apparatus typically include the capability to function as a printer and a photocopier, and can include other capability as well, such as performing the functions of a facsimile machine. By "multi-color" we mean that the imaging apparatus can produce an image having two or more colors, which can include black as a color. Typically, multi-color imaging apparatus are four-color imaging apparatus, which use four base imaging substances (ink or toner) of yellow, magenta, cyan and black to allow a palette of a large number of colors to be imaged. This is typically accomplished by imposing the base colors on top of one another, or in close proximity to one another, and can be enhanced by varying the density of the applied base colors relative to one another. Multi-color imaging apparatus can take the form of liquid ink-jet printing devices, as well as electrophotographic imaging apparatus. The present invention is particularly directed to the latter type of color imaging apparatus.

The electrophotographic ("EP") imaging process is well understood in the art, and need not be described further herein. However, to provide a basis for the following discussion, we will now provide a very brief overview of the EP imaging process. For EP imaging, a light-sensitive optical photoconductor ("OPC") is provided, which is initially provide with a base charge (either positive or negative). The OPC is then selectively exposed by an exposing device (commonly a scanned laser, but light emitting diodes ("LEDs") can also be used) to produce at least a portion of an image on the OPC. The selectively exposed OPC is then placed in contact with an imaging substance (here, toner) having a static electrical potential. The toner is then attracted to (or repelled from) the selectively exposed portions of the OPC, such that a portion of the image to be reproduced is placed on the OPC by the toner. The toner on the OPC is then transferred (directly or indirectly) from the OPC to a sheet of imaging media. The imaging media can be a sheet of paper, a transparency, card stock, or other such media. The transfer of the toner from the OPC to the imaging media is typically accomplished using a corona discharge unit or a charged roller which attracts toner away from the OPC and onto the imaging media. The toner on the imaging media is then fixed to the imaging media using a fusing station, which can use heat and/or pressure to fuse the transferred toner to the imaging media.

The imaging substance (toner) used in the EP imaging process is typically provided in a replaceable cartridge (a "toner cartridge"), which can be replaced when the cartridge is depleted of toner or is otherwise deemed to be beyond the useful life of the cartridge (as will be discussed further below). For typical four-color EP imaging, four toner cartridges are provided: a cartridge containing black toner, a cartridge containing yellow toner, a cartridge containing cyan toner, and a cartridge containing magenta toner. Black toner is typically comprised of carbon particles which can be statically electrically charged, and thus black toner is commonly known as a "magnetic" toner. The electro-static properties of black toner allow it to be easily transferred from place-to-place by electrostatic processes. However, toners for the colors yellow, cyan and magenta are typically comprised of plastic or polymeric particles which do not have the electrostatic properties that black toner has. Accordingly, these non-black toners are typically mixed with a transfer agent that has electrostatic properties and attaches to the polymeric color particles, thus facilitating electrostatic transfer of these polymeric particles in the EP imaging process.

For multi-color EP imaging, a number of different configurations are known. They include at least the following:

I) An imaging apparatus configured to receive two or more (typically four) toner cartridges and two or more (typically four) separate OPC cartridges. (See for example U.S. Pat. No. 5,615,002, which is hereby incorporated herein by reference in its entirety). In this configuration, each OPC cartridge is associated with a respective toner cartridge. The OPC cartridges transfer toner from the respective toner cartridges to an intermediate transfer device (either a belt or a drum). The various colors from the toner cartridges are built-up on the intermediate transfer device ("ITD") to form an image, and the accumulated toner on the ITD is then transferred to a sheet of imaging media to form the final image. This process is commonly known as a "four-pass" imaging process, since the ITD must pass the four OPCs four times to allow all four colors to be accumulated on the ITD. This process allows a wide range of imaging colors since the four colors can be applied on top of one another in various combinations to create a wide range of colors.

II) An imaging apparatus as described immediately above, but wherein the OPCs are incorporated into the toner cartridges. That is, rather than having separate OPC cartridges, the OPCs are part of the respective toner cartridges.

III) An imaging apparatus configured to receive two or more (typically four) toner cartridges, and having a single resident OPC. This configuration provides a low cost multi-color imaging solution. In this configuration, the single resident OPC can be a drum or a belt which can be singly or multiply exposed to form an image thereon. However, due to the difficulty of exposing an OPC through previously developed areas of the OPC (i.e., areas where toner has already been applied to the OPC), in this application the OPC is typically charged only a single time, and then is selectively discharged and selectively exposed to for the four colors. That is, this arrangement typically does not allow for color-on-color toner application to the OPC, but provides for color-next-to-color toner application to the OPC. This arrangement can be described as "single-pass" (versus "four-pass") color imaging, and allows for a much faster imaging time, but at the cost of a limited palette of colors, and reduced quality of the resulting image.

IV) An imaging apparatus having a rotating carousel configured to receive a plurality (typically four) toner cartridges (each cartridge having a dedicated OPC), and an intermediate transfer device (ITD). The toners of various colors are built-up on the ITD device individually. A first toner cartridge is placed in proximity to the ITD, and after the first toner has been applied to the ITD, the carousel rotates to allow the second toner cartridge to place toner on the ITD. Once all of the toner cartridges have been allowed to place toner on the ITD, and thus build-up the image on the ITD, the resultant image is then transferred from the ITD to a sheet of imaging media.

In each of these configurations there are a number of rotating cylindrical toner transfer devices. These toner transfer devices can include at least the following devices: the OPC; a toner transfer roller to transfer toner from a toner reservoir to the OPC; a charge roller which is used to charge the OPC with a base charge; and a cleaning brush. In some configurations a corona discharge unit is used instead of a charge roller OPC to charge the OPC. Further, the OPC typically is in contact with a cleaning blade which scrapes any residual toner from the OPC before the OPC is recharged. In some applications a doctor blade is in contact with the toner transfer roller to more evenly distribute toner across the transfer roller before the toner is transferred to the OPC. Each time one of these rotating toner transfer devices is cycled (rotated) it experiences a small amount of wear. Over time, these rotating toner transfer devices should be periodically replaced to maintain image quality and also to avoid mechanical failure. To this end, many EP imaging apparatus are provided with counters or sensors which count or detect the number of cycles a rotating toner transfer device has experienced. When the recommended life of the device expires, the imaging apparatus can signal a user via a user display that it is time to replace the device. In other configurations, to reduce the chance of damage to an imaging apparatus, the imaging apparatus can be configured to disable operation of the imaging apparatus until the recommended replacement is made.

In addition to the toner transfer devices mentioned above, there can be other components (such as gears and belts) that drive the rotating toner transfer devices. These components also experience wear as they are cycled during operation.

The counters that are used to record the number of rotations of a rotating toner transfer device can take a number of different configurations. In one configuration the counter can be software driven. In this example a "useful life" value is automatically stored in a computer readable memory when a new rotating toner transfer device is placed into the imaging apparatus, and each time an image is generated the "useful life" value is decreased by a given amount. When the "useful life" value reaches a preselected number (zero, for example) then the imaging apparatus can notify the user that the respective device has reached the end of its recommended life. In another configuration, a sensor can be placed next to the rotating toner transfer device. Each time the device is rotated the sensor detects the number of rotations, and the detection signal is accumulated in a memory device. When the accumulated value in the memory devices reaches a value equivalent to "useful life", the user can be notified.

In at least the first three of the four configurations of multi-color imaging apparatus described above, all of the rotating toner transfer devices in the imaging apparatus are cycled each time an image is generated. Thus, for example, if a user is printing a black-and-white text document using a four-color imaging apparatus, the OPCs for all four toners (black (B), yellow (Y), cyan (C) and magenta (M)) will be cycled. Since only the OPC for black toner is being used, this results in needless cycling of, and wear on, the yellow, cyan and magenta OPCs. Further, if the OPC is located within a toner cartridge, the imaging apparatus can indicate to a user that the cartridge needs to be replaced based on wear of the OPC even when there may still be a useful quantity of toner remaining in the cartridge. For many multi-color imaging apparatus the number of black-and-white images generated is a significant fraction of the overall number of images generated. Accordingly, the non-black toner transfer devices in these multi-color imaging apparatus experience a significant amount of unnecessary wear.

SUMMARY OF THE INVENTION

One embodiment of the present invention is a multi-color imaging apparatus configured to support a plurality of color-associated rotatable-toner-transfer-devices. The imaging apparatus includes a rotatable-toner-transfer-device disengagement unit configured to selectively disengage a selected color-associated rotatable-toner-transfer-device. The selection is dependent on whether the selected color-associated rotatable-toner-transfer-device is required to generate an image. In one non-limiting example the imaging apparatus can further include a processor and a computer readable memory device. In this example a rotatable-toner-transfer-device disengage program can be stored in the memory device. The program is executable by the processor to allow the rotatable-toner-transfer-device disengagement unit to selectively disengage the selected color-associated rotatable-toner-transfer-device.

Another embodiment of the present invention is a method of reducing wear on wearable color-associated components within a multi-color imaging apparatus configured to generate both single-color and multi-color images on imaging media. The method includes identifying a selected color-associated component which will not be used to generate the image, and disengaging the selected color-associated component during imaging of the image. Non-limiting examples of wearable color-associated components within the multi-color imaging apparatus include an optical photoconductor and a toner distribution roller.

These and other aspects and embodiments of the present invention will now be described in detail with reference to the accompanying drawings, wherein:

DETAILED DESCRIPTION OF THE INVENTION

Figure 1:
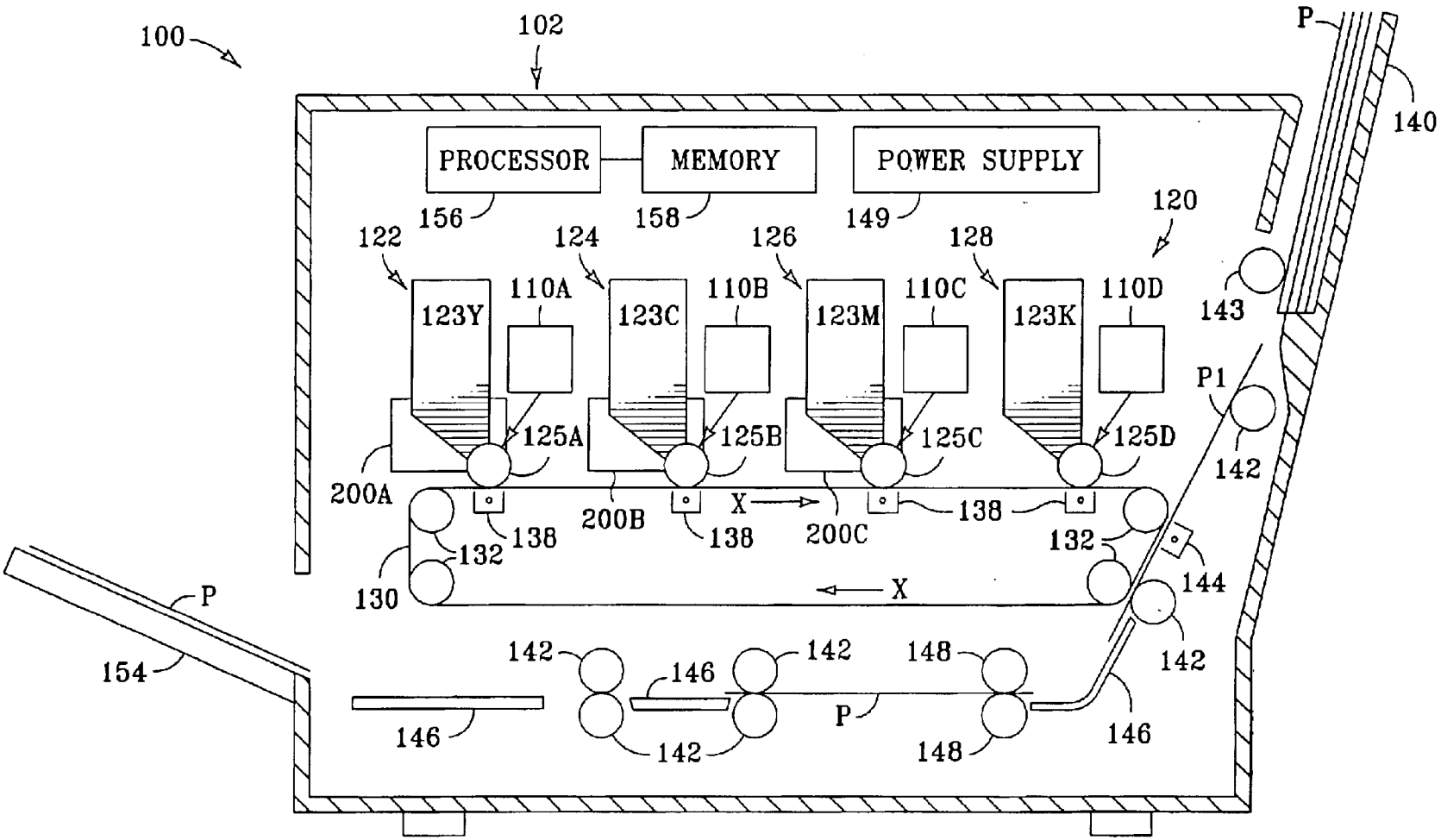
FIG. 1 depicts a side sectional view of a multi-color imaging apparatus in accordance with one embodiment of the present invention.

The present invention provides methods and apparatus for reducing the wear on selected components in a multi-color imaging apparatus. More specifically, the present invention is primarily directed to such methods and apparatus for reducing wear on color-associated rotatable-toner-transfer-devices. Multi-color imaging apparatus include printers, photocopiers, facsimile machines, and other devices that can be used to generate an image on imaging media (such as paper, transparencies, cardstock, etc.). By "multi-color" we mean that the imaging apparatus can generate an image having more than one color. Typically, one of the colors will be black. In most common multi-color imaging apparatus the other colors are yellow, cyan and magenta, which, separately and in combination with one another and with the black color, can produce a large palette of colors. When these four basic colors are available in an imaging apparatus, the apparatus is known as a 'four color imaging apparatus".

The present invention is directed primarily to multi-color imaging apparatus that use an electrophotographic ("EP") imaging process to generate images, as described above. As also described above, the color EP imaging process uses colors that are provided in the way of dry toners. The movement of the toners through the imaging apparatus is facilitated by a plurality of color-associated rotatable-toner-transfer-devices. Examples of such color-associated rotatable-toner-transfer-devices include (without limitation), optical photoconductors ("OPCs"), toner transfer rollers (to move toner towards the OPC), rotating cleaning brushes, charge rollers (when used), toner stirring devices which are used to agitate toner in the toner cartridge, and drive wheels and motors which facilitate rotating of the aforementioned components. By "color-associated", we mean that the rotatable-toner-transfer-device is associated with a particular color of toner. For example, a first OPC can be associated with black toner, a second OPC can be associated with yellow toner, and so on. For the sake of simplicity, we may refer to rotatable-toner-transfer-devices herein as simply, "toner transfer devices", "transfer devices", or "devices" when the context makes it clear that we mean "rotatable-toner-transfer-devices".

As will be described more fully below, the present invention provides for disengaging selected rotatable-toner-transfer-devices within a multi-color imaging apparatus when selected ones of those devices will not be required to generate a specific image. This is accomplished using a rotatable-toner-transfer-device disengagement unit (which we will call a "disengagement unit" for the sake of simplicity). For example, if a multicolor imaging apparatus is capable of generating an image using yellow ("Y"), cyan ("C"), magenta ("M") and black ("K") toners, but an image to be generated only requires black toner, then selected rotatable-toner-transfer-devices associated with the associated with the Y, M and C toners can be disengaged during the imaging process, thereby reducing wear on these selected components.

Turning now to FIG. 1, a side section of a multi-color imaging apparatus 100 in accordance with a first embodiment of the present invention is depicted. Although imaging apparatus 100 is depicted as being a four-color imaging apparatus, the present invention can also work with an imaging apparatus having as few as two colors. The imaging apparatus 100 includes a housing 102, a paper feed tray 140 which can support imaging media "P", and a paper output tray 154 which can support imaged media. The imaging media P can be moved into the imaging apparatus 100 by a pick-roller 143, and moved along media guides 146 by feed rollers 142. The imaging apparatus 100 includes a four-color expose-develop section 120 which includes four imaging stations: station 122 for yellow toner, station 124 for cyan toner, station 126 for magenta toner, and station 128,for black toner. Each station 122, 124, 126 and 128 includes a removeable color toner cartridge (cartridges 123Y, 123C, 123M and 123K) and an associated OPC (OPCs 125A, 125B, 125C and 125D). The OPCs 125A–125D can be supported in separate OPC support frames, or they can be integral with the associated toner cartridges (123Y, 123C, 123M and 123K). Each station 122, 124, 126 and 128 also includes an associated expose-device (110A–110D) which can be used to selectively expose the associated OPCs (125A–125D). Typically, the expose-device includes a scannable laser. Imaging stations 122, 124 and 126 are also provided with associated rotatable-toner-transfer-device disengagement units 200A, 200B and 200C. It should be noted that imaging station 128 is not depicted as including a rotatable-toner-transfer-device disengagement unit, although one can be provided. The reason imaging station 128 does not include a rotatable-toner-transfer-device disengagement unit is that there will be very few times when an image is to be created that does not include black toner.

An intermediate transfer device ("ITD") 130 is provided upon which a multi-color image can be developed prior to being transferred to a sheet of imaging media P1. The ITD 130 is depicted as being a belt supported by rollers 132, although it can also be a drum. Beneath the ITD 130, and adjacent each OPC 125A–125D, is a corona unit 138 which is used to transfer toner off of the OPC and onto the ITD. As the belt 130 moves in direction X, after the image has been fully developed on the belt an image transfer corona discharge unit 144 pulls the toner onto the imaging media P1. The toner is then fused to the sheet by fusers 148. It will be noted that the corona discharge units 138 and 144 can be replaced by charge rollers.

The imaging apparatus can also include a processor 156 and a computer-readable memory device 158 (such as a random-access memory devices and read-only memory devices) which can be accessed by the processor. The processor 156 and the memory device 158 can also be located outside of the imaging apparatus (for example, in a connected computer), but are preferably located within the imaging apparatus 100. The processor 156 can be used to control the operation of the imaging apparatus 100, and an image file can be stored in the memory device 158. The processor 156 and the memory device 158 can also be used to control the disengagement units 200A–200C, as will be described more fully below. The imaging apparatus 100 can also include a power supply 149 which can provide electrical power for the processor 156 and other electrical components (motors, scanning lasers, corona discharge units, fusers, etc.) within the imaging apparatus.

In operation, the disengagement units 200A–200C can be used in any combination to disengage associated rotatable-toner-transfer-devices. For example, if an image is to be generated using only black toner, then all three disengagement units 200A–200C are preferably used to disengage selected rotatable-toner-transfer-devices associated with the yellow-cyan-magenta imaging stations 122, 124 and 126. Likewise, if an image is to be generated which does not require cyan toner, then disengagement unit 200B is used to disengage only the cyan-associated rotatable-toner-transfer-devices. The operation of the disengagement units 200A–200C can be controlled by a rotatable-toner-transfer-device disengage program ("disengage program") which can be stored in the memory device 158. The disengage program (170, FIG. 6) can be executed by the processor 156 (FIG. 1) to allow the disengagement units 200A–200C to selectively disengage the selected color-associated rotatable-toner-transfer-device (such as OPC 125A, 125B and/or 125C).

Figure 2:
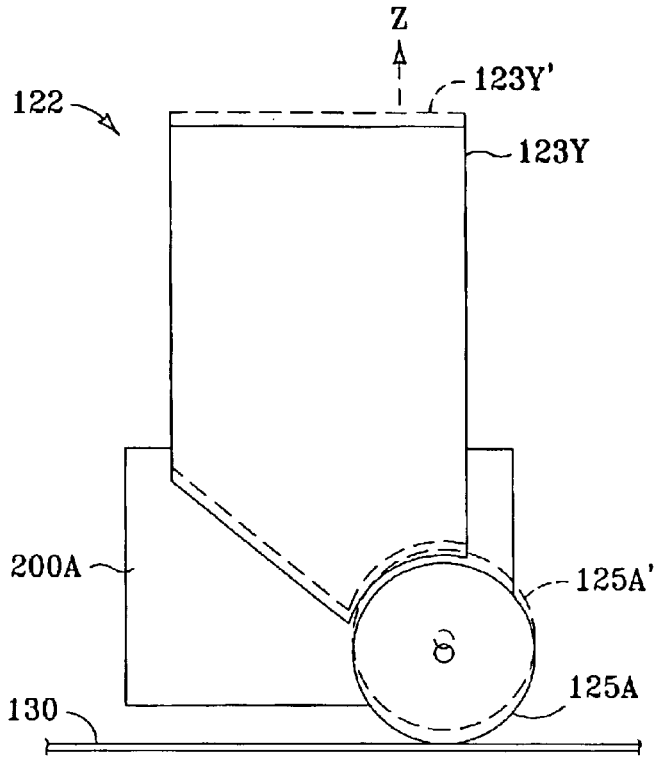
FIG. 2 is a schematic diagram depicting in side view how an optical photoconductor and a toner cartridge in the imaging apparatus of FIG. 1 can be moved to disengage them from an intermediate transfer device.

Turning now to FIG. 2, a schematic diagram of disengage unit 200A of FIG. 1 is depicted in side view, showing how the disengage unit can function to disengage the rotatable-toner-transfer-device which is the OPC 125A. In this example, the disengage unit 200A moves the OPC 125A upward in direction Z to the position indicated in dashed lines by 125A'. In this way the OPC 125A is moved out of contact with the ITD 130. Since the OPC 125A is typically in contact with the ITD 130 when toner from cartridge 123Y is to be used in an imaging process, moving the OPC away from the ITD will eliminate frictional wear on the OPC (as well as the ITD) when the OPC is not going to be used to generate an image. In this example, the disengage unit 200A is also used to move the toner cartridge 123Y upward in direction Z (indicated by dashed lines 123Y'). The reasons for moving the toner cartridge 123Y upward are twofold. Firstly, in certain configurations the toner cartridge 123Y can interfere with upward movement of the OPC 125A, and so the toner cartridge must be moved to allow upward movement of the OPC. Secondly, if the OPC 125A is integral with the toner cartridge 123Y, then by moving the toner cartridge upward, the OPC is moved upward as well.

Figure 3:
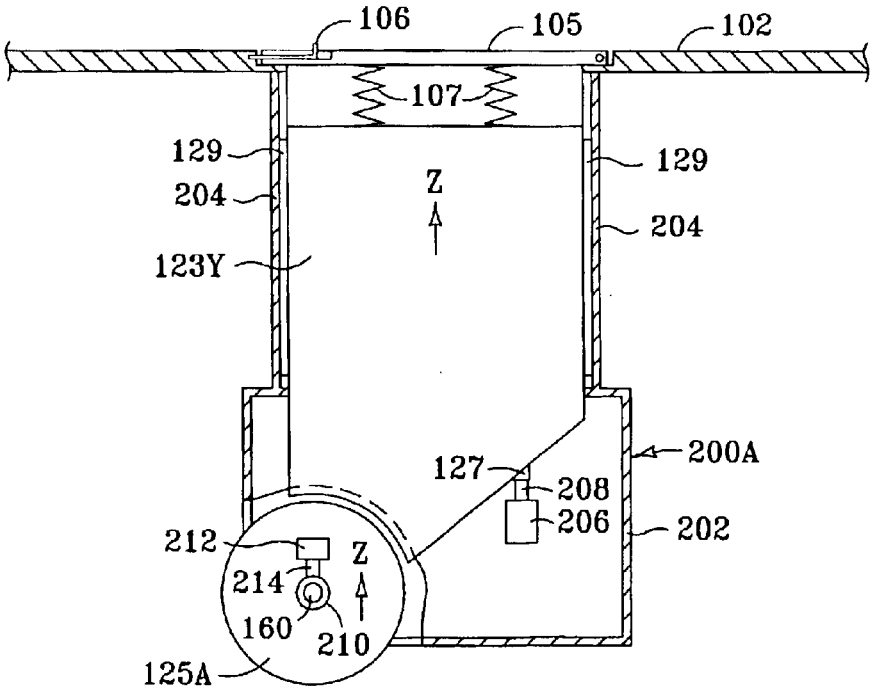
FIG. 3 is a schematic diagram similar to FIG. 2 but additionally depicting components of a rotatable-toner-transfer-device disengagement unit that can be used to disengage the optical photoconductor and move the toner cartridge.

Turning to FIG. 3, a more detailed side elevation sectional view of the schematic of FIG. 2 is depicted, except that in FIG. 3 the view of the-disengage unit 200A and the toner cartridge 123Y is viewed from the opposite end of that shown in FIG. 2. FIG. 3 depicts one example of components that can be used in the disengage unit 200A to accomplish the movement depicted in FIG. 2. It will be appreciated that disengage units 200B and 200C can be configured similarly as disengage unit 200A. As shown in FIG. 3, the OPC 125A is supported in a collar 210 by shaft 160. A primary actuator 212 is connected by a connecting link 214 to collar 210. When the actuator acts on the connecting link 214, the collar 210 (and hence the OPC 125A) moves upward in direction Z. The actuator 212 can be, for example, a solenoid or a cam-driven arm. The actuator 212 can be supported either with the disengage unit housing 202, or outside of the housing. A similar disengage unit can also be provided on the opposite end of the OPC 125A.

As indicated in FIG. 3, the disengage unit 200A can also include a second actuator 206 which acts on a second connecting link 208 to move the toner cartridge 123Y in the upward "Z" direction. As with first actuator 212, the second actuator 206 can be, for example, a solenoid or a cam-driven arm. In the example depicted in FIG. 3, the second actuator is a solenoid which moves connecting link (piston or shaft) 208 against a foot 127 which is connected to the toner cartridge 123Y. In order to provide a restorative force to move the toner cartridge 123Y back into its normal position (i.e., the position where toner will be used for imaging), the toner cartridge 123Y can be moveably supported within the imaging apparatus housing 102 by guides 204 which receive tabs 129 located on the sides of the toner cartridge 123Y. An access panel 105, fitted in housing 102, allows the toner cartridge 123Y to be inserted into, and removed from, the imaging apparatus (100, FIG. 1). Biasing members (here, springs 107) can be attached to the inside of the access panel 105 so that they allow upward movement of the toner cartridge, but provide a restorative force when the second actuator 206 is released. A latch 106 can hold the access panel 105 in place against the force of the biasing members 107.

Figure 9:
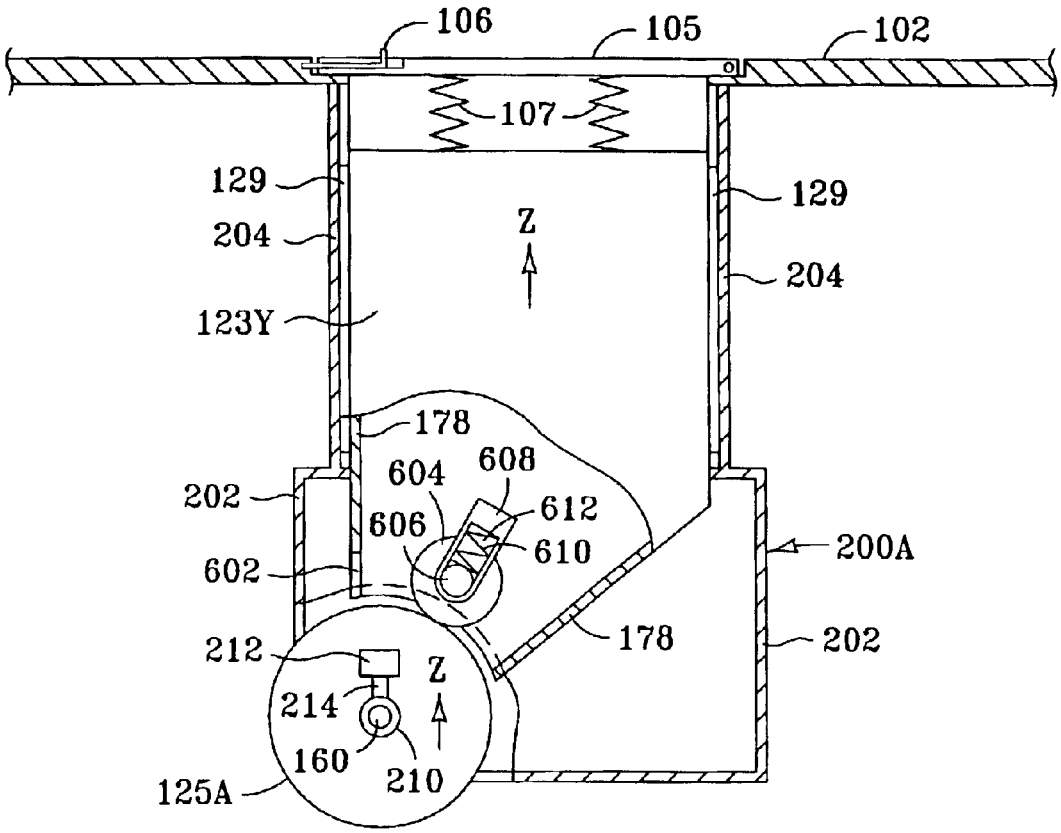
FIG. 9 is a schematic diagram similar to FIG. 3 but showing how the toner cartridge can remain static rather than being moved as in FIG. 3.

Turning to FIG. 9, an alternate example to that depicted in FIG. 3 is provided. As can be seen, FIG. 9 depicts many of the same like-numbered components as depicted in FIG. 3, and these like-numbered components need not be explained further. In the configuration depicted in FIG. 9 the toner cartridge 123Y is not moved. In this example the toner cartridge housing 178 is provided with a cut-out 602, allowing upward movement of the OPC 125A with respect to the toner cartridge 123Y. However, as the toner cartridge most likely will contain a toner transfer roller 604 which is either in contact with, or in very close proximity to, the OPC 125, provisions need to be made to avoid interference between the two as the OPC is moved in direction "Z". One example depicted in FIG. 9 provides for mounting the toner transfer roller 604 on a shaft 606 which is supported in a mounting 608. The mounting 608 defines a slot 612 which allows movement of the shaft 606, thus allowing the OPC 125 to "push" the toner transfer roller 604 out of the way when the OPC is moved upward. A biasing member (such as spring 610) can be placed in the slot 612 to provide a restorative force to the toner transfer roller 604 after the OPC 125A is moved back to its normal (downward) position.

It will be appreciated in FIGS. 3 and 9 the OPC 125A can be integral with the toner cartridge 123Y, so that in FIG. 3 only one of the first actuator 212 or the second actuator 206 is needed to affect upward movement of the OPC and the toner cartridge. It will also be appreciated that in FIGS. 3 and 9 the OPC 125A can be separate from the toner cartridge 123Y.

In addition to moving a rotatable-toner-transfer-device away from an object to "disengage" the transfer device (as exemplified in FIG. 3), the present invention can also include disengaging the rotatable-toner-transfer-device from one or more driving components. This is desirable since disengaging rotation of a rotatable-toner-transfer-device will further reduce wear on the disengaged transfer device, as well as wear on the driving components used to drive the transfer device. A variety of different configurations, for driving rotatable-toner-transfer-devices within an imaging apparatus are known. While an ITD can be used as a friction drive device to drive an OPC when the two are in contact, in reality this arrangement is rarely used. In some configurations each OPC in a multi-color imaging apparatus is provided with a dedicated drive system which includes a drive motor and gears, belts, rollers, or some combination thereof. Frequently the dedicated drive system for an OPC is also used to drive other associated rotatable-toner-transfer-devices, such as toner transfer rollers, cleaning brushes, and so on. In other configurations rotatable-toner-transfer-devices from different imaging stations (122, 124, 126, 128, FIG. 1) are driven by a common drive system, which can include gears, belts, rollers, and combinations thereof.

Figure 10:
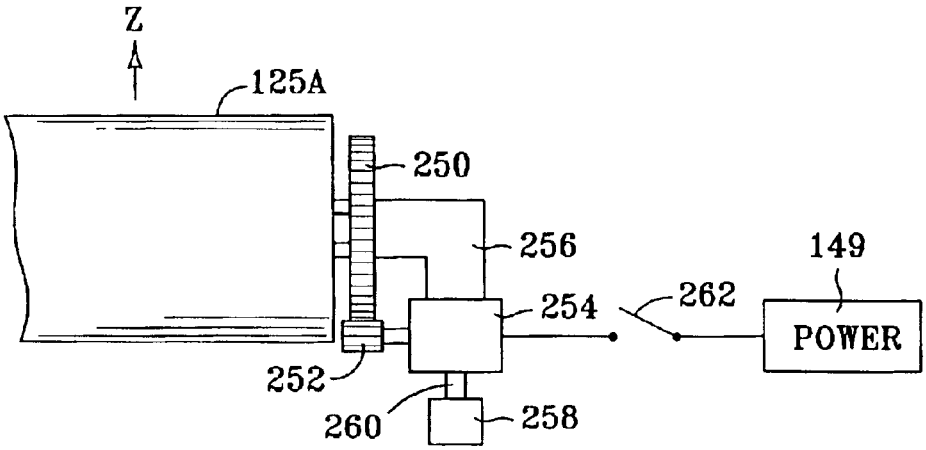
FIG. 10 is a partial front view similar to FIG. 4 but depicts different additional components of a rotatable-toner-transfer-device disengagement unit that can be used to disengage an OPC.

Turning now to FIG. 10, one example of how a disengagement unit of the present invention can disengage a rotatable-toner-transfer-device is depicted in a front view. The rotatable-toner-transfer-device depicted in FIG. 10 is OPC 125A. OPC 125A is driven by a secondary drive wheel 250, which can be a friction wheel or a gear. The secondary drive wheel 250 is in turn driven by a primary drive wheel 252 (which can be a friction wheel or a gear), and which is driven by motor 254. Primary drive wheel 252 can alternately be driven by a belt or a tertiary gear or roller, which can in turn be ultimately driven by a motor. When drive wheels 250 and 252 are friction rollers, then the OPC 125A can be disengaged merely by moving it upwards (as depicted in FIG. 2) so that the secondary drive wheel 250 (FIG. 10) is out of contact with the primary drive wheel 252. When OPC 125A is thus moved upward in direction Z (as in FIG. 2), then motor 254 can be disabled so that it does not operate (as for example by disconnecting it from the power supply 149 by switch 262), thus saving power consumption and wear on the motor. When OPC 125A is then moved back to its normal operational position, secondary drive wheel 250 and primary drive wheel 252 will come in contact so that the OPC 125A can be driven by the motor 254.

However, when the drive wheels 250 and 252 are geared drive wheels, then the configuration just described is less preferable since the gears may not mesh when the OPC 125A is returned to its normal operating position. In this event the OPC 125A and the motor 254 can be connected by a connector frame 256. An actuator 258 (including connecting link 260) in the disengagement unit can then act on the motor 254 (or the connector frame 256) to move both the primary and secondary drive wheels (250, 252) upward in concert. This will eliminate the possibility of gear clash when the OPC 125A and the motor 254 are returned to their normal operating position.

Figure 4:
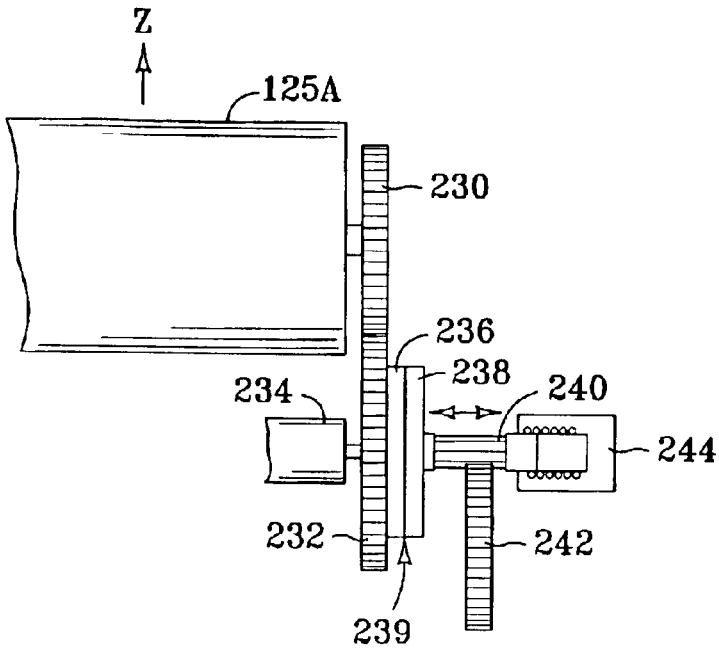
FIG. 4 is a partial front view of an optical photoconductor ("OPC") and additional components of a rotatable-toner-transfer-device disengagement unit that can be used to disengage the OPC from a drive wheel.

We have described in FIG. 10 a rotatable-toner-transfer-device disengagement unit which can be used when the rotatable-toner-transfer-device (e.g., OPC 125A) is driven by a dedicated drive system. We will now describe with respect to FIG. 4 a rotatable-toner-transfer-device disengagement unit which can be used when the rotatable-toner-transfer-device is driven by a common drive system (i.e., one that drives transfer devices for multiple color imaging stations). As depicted in FIG. 4, rotatable-toner-transfer-device (OPC 125A) is driven by a secondary drive wheel 230, which can be a gear or a friction roller. The secondary drive wheel 230 is indirectly driven by primary drive wheel 242, which engages a spline gear 240. The spline gear 240 is connected to a first clutch plate 238 of a clutch 239. The clutch 239 further includes a second clutch plate 236 which is connected to a tertiary drive wheel 232, and the tertiary drive wheel is supported in the imaging apparatus by bearing 234. The tertiary drive wheel 232 engages the secondary drive wheel 230, thus allowing the primary drive wheel 242 to drive the OPC 125A.

As can be seen in FIG. 4, the use of a spline gear 240 allows the first clutch plate 238 to translate left and right, thus engaging and disengaging the clutch 239. As is apparent, when the clutch 239 is disengaged, the OPC 125A will not be driven. A clutch actuator 244 (such as a solenoid) can be used to cause left-right translation of the first clutch plate 238. Accordingly, in the common-drive system configuration depicted in FIG. 4, the rotatable-toner-transfer-device (OPC 125A) can be selectively disengaged by use of the clutch 239, thus allowing the common drive system to continue to operate.

Another common practice in imaging apparatus is to use a single drive system to drive various rotatable-toner-transfer-devices associated with a common toner color. For example, a belt system or a series of gears can be used to drive an OPC, a toner transfer roller, and other rotatable-toner-transfer-devices associated with a single toner color. These drive systems can also be incorporated into a comprehensive drive system which allows rotatable-toner-transfer-devices for different color toners to be driven by a common drive system. We have described above with respect to FIG. 4 how a drive system for a selected toner color can be isolated from a common (multi-toner-color) drive system. We will now describe how a drive system which drives multiple rotatable-toner-transfer-devices for a single color can be accommodated into a disengagement unit of the present invention.

Figure 5:
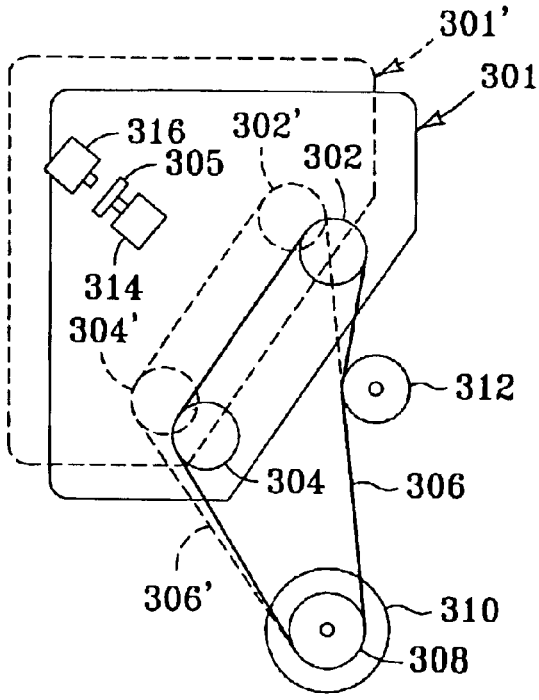
FIG. 5 is a side schematic diagram depicting additional components of a rotatable-toner-transfer-device disengagement unit that can be used to allow movement of a rotatable-toner-transfer-device away from a fixed driving wheel.

Turning to FIG. 5, a side view of a toner cartridge 301 for a selected toner color is depicted. In the example depicted in FIG. 5 the toner cartridge 301 is to be moved upward and leftward (as indicated by dashed lines 301') to thereby facilitate disengagement of rotatable-toner-transfer-devices associated with the color of the toner in cartridge 301 (similar to the upward movement of toner cartridge 123Y in FIG. 2). In the configuration depicted in FIG. 5 a primary drive wheel 308 (which can be driven by a motor 310, or can be driven by a belt or a gear from a remote motor) engages a drive belt 306, which in turn engages secondary drive wheels 304 and 302. Drive wheel 304 can drive a toner transfer roller, and drive wheel 302 can engage a toner agitator, for example. A primary actuator 314 can move the rotatable-toner-transfer-devices (transfer roller driven by drive wheel 304 and agitator driven by drive wheel 302) to a disengaged position. If one of the rotatable-toner-transfer-devices is an OPC, then the primary actuator 314 can move the OPC out of contact with an intermediate transfer device (such as in FIG. 2 where OPC 125A is moved out of contact with belt 130). The primary actuator 314 can be mounted to the disengagement unit (not specifically identified in FIG. 5), and can act on member 305 which can be attached to the toner cartridge 301. A secondary actuator 316 can be used to move the toner cartridge 301 (and thus the related rotatable-toner-transfer-devices) back to their normal operating position once the image causing the selective disengagement has been generated. Since the primary drive wheel 308 will typically be fixed with respect to the imaging apparatus, yet the secondary drive wheels 302, 304 will need to move with respect to the apparatus when the toner cartridge 301 is moved to position 301', the portion of the disengagement unit depicted in FIG. 5 can include a belt-extending roller 312 which allows the effective length of the belt 306 to be increased when the primary actuator 314 moves the color-associated rotatable-toner-transfer-devices (indicated by secondary drive wheels 304 and 302) to a position away from the intermediate transfer device (indicated by respective dashed lines 304' and 302'). The belt-extending roller 312 can push the belt 306 inward towards secondary drive wheels 302 and 304 when the toner cartridge is in the normal operational position, thus effectively shortening the length of the belts with respect to primary drive wheel 308. When the toner cartridge 301 is moved to position 301' (and thus secondary drive wheels are moved to positions 302' and 304'), the belt 306 moves out of contact with the belt-extending roller 312, thus effectively lengthening the belt 306 with respect to static primary drive wheel 308 and moveable secondary drive wheels 302 and 304.

Figure 6:
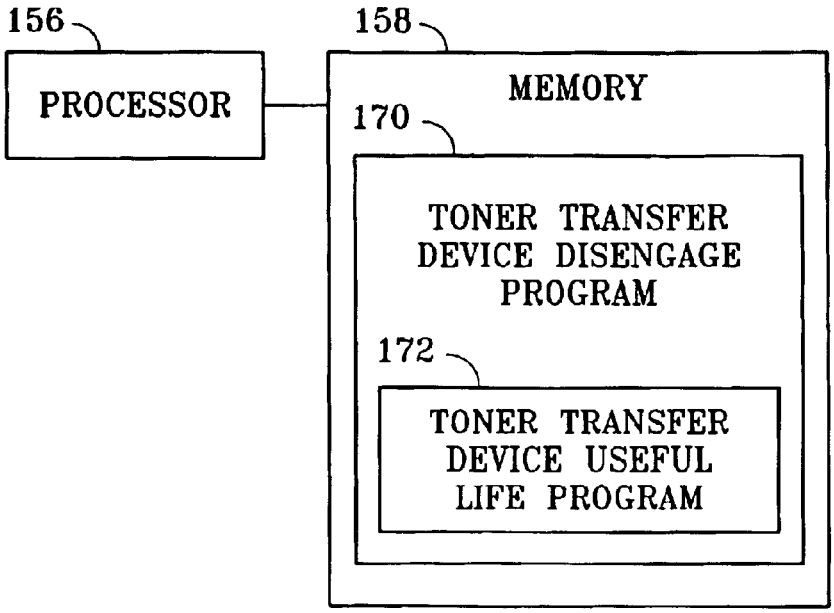
FIG. 6 is a schematic diagram depicting components of a system that can be used to selectively disengage color-associated rotatable-toner-transfer-devices.

In another embodiment, the present invention includes a system to selectively disengage a color-associated rotatable-toner-transfer-device in an imaging apparatus. FIG. 6 depicts a portion of such a system in a schematic diagram. The system includes a rotatable-toner-transfer-device disengagement unit (such as 200A–200C of FIG. 1, as further detailed in examples set forth in FIGS. 2–5 and FIGS. 9 and 10). The system includes a processor (such as processor 156 of FIGS. 1 and 6) and a computer readable memory device (such as memory device 158 of FIGS. 1 and 6). The system further includes a rotatable-toner-transfer-device disengage program (170, FIG. 6), which will be also known herein as the "disengage program". The disengage program 170 can be stored in the memory device 158, and can be executed by the processor 156 to allow the rotatable-toner-transfer-device disengagement unit (or units) (e.g., 200A–200C, FIG. 1) to selectively disengage one or more color-associated rotatable-toner-transfer-devices.

In one example of the system described above, the imaging apparatus (e.g., apparatus 100 of FIG. 1) can be configured to generate an image (using a black toner and one or more non-black toners) on imaging media based on an image file. In this example the disengage program (170, FIG. 6) can be configured to analyze the image file and to determine if non-black toner(s) will be used to generate the image. If non-black toner(s) will not be used (i.e., the image will be generated using only black toner) then the disengage program 170 can cause the disengagement unit(s) (e.g., 200A–200C, FIG. 1) to disengage the transfer device(s) associated with the non-black toner(s). For example, if only black toner is to be used to generate the image, then selected transfer devices associated with yellow, cyan and magenta imaging stations 122, 124 and 126 (FIG. 1) will be disengaged.

In the example just described the disengage program (170, FIG. 6) determines whether an image will be imaged using only black, or black and other color components. If only black toner is to be used to create the image, then all non-black disengageable toner transfer devices are disengaged. In another example of a system to selectively disengage one or more color-associated rotatable-toner-transfer-devices in a multi-color imaging apparatus, the disengage program (170, FIG. 6) determines what colors will not be required to generate the image. The disengage program then causes the disengage unit(s) to disengage those selected rotatable-toner-transfer-device(s) associated with the non-used colors to be disengaged before the image is generated. That is, the disengage program (170, FIG. 6) can be configured to analyze the image file and to determine whether a selected toner will be used to generate the image. When a selected toner (or toners) will not be used, the disengage program can cause the disengagement unit(s) to disengage the color-associated transfer-device(s) which is/are associated with the selected toner(s). For example, if the available toners include toners of yellow, cyan, magenta and black, and the image is to be generated using only toners of cyan and magenta, then the disengage program will cause selected rotatable-toner-transfer-devices associated with black and yellow toner to be disengaged during the imaging process.

In yet another variation, the disengage program (e.g., 170, FIG. 6) can be configured to analyze a multi-page image file and to determine those pages of the image file which do not require a particular toner (of multiple available toners) to be used to create the image to be generated by the multi-color imaging apparatus (e.g., apparatus 100 of FIG. 1). When an identified selected toner will not be used to generate a selected page of the image, the disengage program (e.g., 170, FIG. 6) can cause the rotatable-toner-transfer-device disengagement unit(s) (e.g., units 200A–200C of FIG. 1) to disengage the transfer devices which are not associated with the selected toner(s) for the selected page. For example, if a three-page document to be imaged includes pages 1 and 3 which are only to be imaged using black toner, yet page 2 of the document is to be imaged using black and cyan, then the disengage program will determine that for pages 1 and 3 of the document, all non-black disengagable transfer devices should be disengaged during the printing of those pages. However, for the printing of page 2 (which required both black and cyan toner to image the page), the disengage program will determine that all non-black and non-cyan disengagable transfer devices should be disengaged during the printing of that page.

As described previously, certain imaging apparatus can "determine" the useful remaining life of a rotatable-toner-transfer-device based on either detecting actual use of a component (such as detecting the number of rotations of an OPC with a sensor), or by a software solution which deducts a count from a counter (or adds a count to a counter) each time an image is generated. For the former type of arrangement (i.e., detecting actual use of the component), the usage counter for a particular set of color-associated rotatable-toner-transfer-devices will be effectively disabled when the transfer devices are disengaged by the disengagement unit. For example, if the disengagement of an OPC results in the OPC not being rotated while an image is being generated, then a sensor will not detect any rotation (there being none) of the OPC, and the associated counter will not be cycled to indicated a reduced remaining life, for the OPC. However, when there is a common counter system for determining the remaining useful life all like-kind transfer devices in a multi-color imaging apparatus (e.g., one counter for all OPCs), then disengaging an OPC will not disable the useful life counter for that OPC. To address this situation, the disengage program (170, FIG. 6) described above can include a "Toner Transfer Device Useful Life Program" (172, FIG. 6), which is depicted more particularly in FIG. 11.

Figure 11:
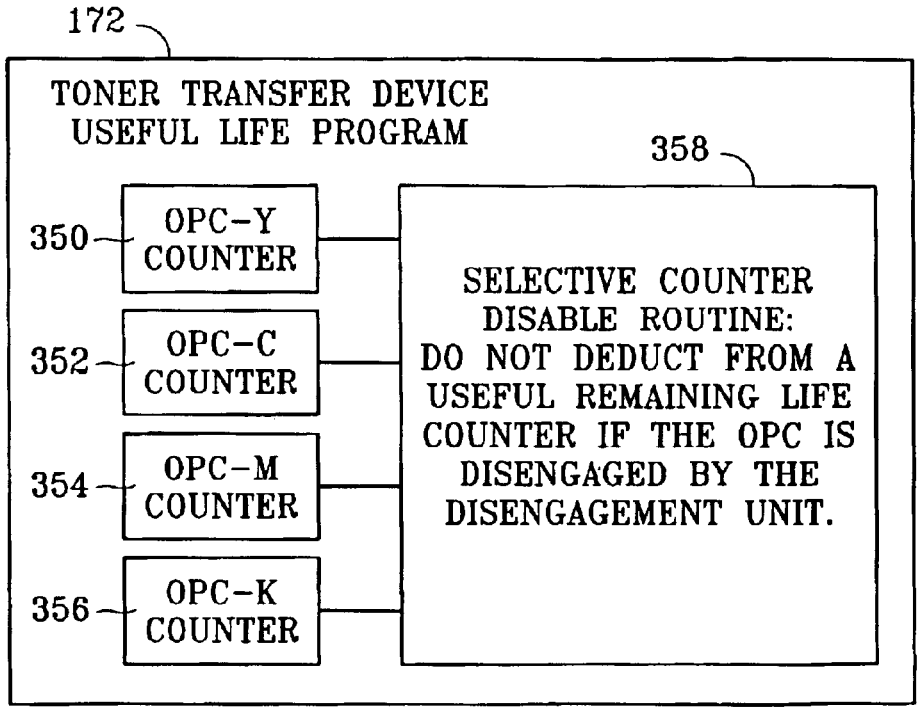
FIG. 11 is a schematic diagram of a Toner Transfer Device Useful Life Program that can be used in embodiments of the present invention.

Turning now to FIG. 11, the Toner Transfer Device Useful Life Program 172 ("which will be referred to herein as the "useful life program" for simplicity) is depicted in a schematic diagram. In the example depicted in FIG. 11, the only transfer device which is being monitored for remaining useful life is the OPCs. However, it will be appreciated that the remaining useful life of other toner transfer devices can also be monitored. As shown in FIG. 11, there are four counters—counter 350 for the yellow OPC, counter 352 for the cyan OPC, counter 354 for the magenta OPC, and counter 365 for the black OPC. Obviously, more or less counters can be used if there are more or less toner colors. Further, in one variation the counters for the non-black toner OPCs can be combined into a single counter, since in most instances either all four toner colors will be used, or only black will be used. The counters 350, 352, 354 and 356 can be memory locations in a RAM memory device. The useful life program 172 also includes a "Selective Counter Disable Routine" 358 ("disable routine"), which, as indicated, causes the useful life in a counter 350, 352, 354 and 356 to not be reduced if the associated OPC is to be disengaged by an associated disengagement unit.

Another embodiment of the present invention provides for a method of reducing wear on wearable color-associated components within a multi-color imaging apparatus. In this case the multi-color imaging apparatus is configured to generate both single-color and multi-color images on imaging media. Imaging apparatus 100 of FIG. 1 is an example of one such apparatus, and incorporates four imaging colors (yellow, cyan, magenta and black), although the invention can work for a multi-color imaging apparatus having as few as two colors, or any number of colors. Examples of "wearable color-associated components" can include any of the rotatable-toner-transfer-devices described above (e.g., OPCs, toner transfer rollers, gears, belts, motors, etc.). The method includes identifying a selected color-associated component which will not be used to generate the image, and disengaging the selected color-associated component. Thereafter the image is generated while the selected color-associated component is disengaged. It will be appreciated that the method can be applied not only to EP imaging apparatus, but other types of multi-color imaging apparatus as well, such as ink jet printers, dry toner (or "phase change") printers, and others.

As indicated, the method can include disengaging only a single color-associated component which will not be used to generate an image. However, preferably the method includes identifying a plurality of selected color-associated components which will not be used to generate the image, and disengaging the plurality of selected color-associated components, after which the image is generated while the disengaged components remaining disengaged. For example, multiple components associated with a single color can be disengaged (e.g., the OPC and the toner transfer roller for yellow toner). Likewise, multiple components associated with different toners can be disengaged (e.g., yellow and cyan OPCs), and further multiple components within multiple colors can be disengaged.

In one example the selected color-associated component can be disengaged by moving the selected color-associated component out of contact with a secondary component. For example, see FIG. 2 wherein OPC 125A is moved out of contact with the ITD 130. In another example the selected color-associated component can be disengaged by decoupling the selected color-associated component from a driving member which can be used to drive the selected color-associated component. For example, see FIG. 10 wherein OPC 125A can be disconnected from drive motor 254 by electrical switch 262; also see for example FIG. 4 wherein OPC 125A can be disconnected from drive wheel 242 by clutch 239.

Figure 7:
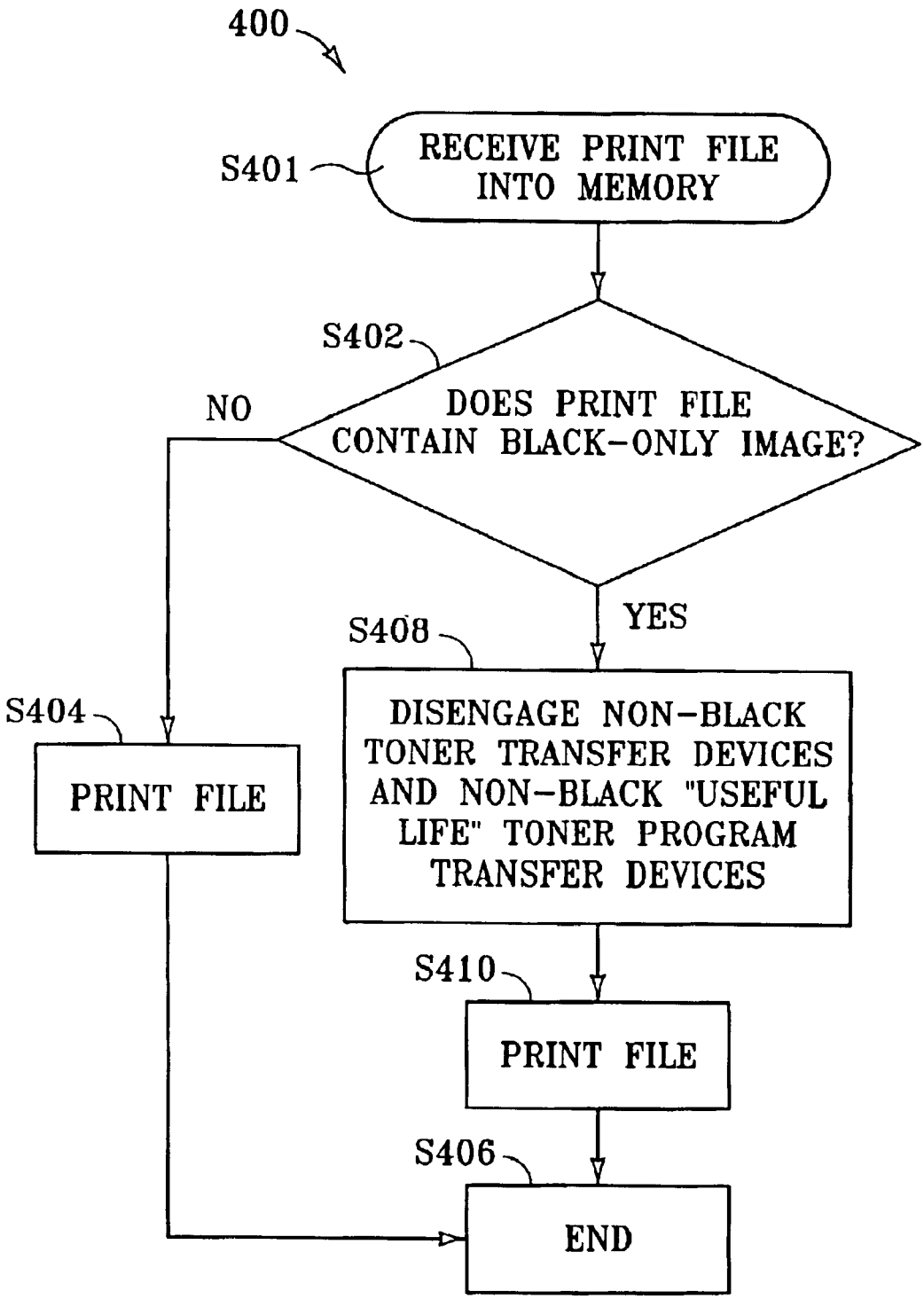
FIG. 7 depicts a flowchart of a first rotatable-toner-transfer-device disengage program that can be used in embodiments of the present invention.

In another variation on the method of the present invention the imaging apparatus can be a four-color imaging apparatus (such as imaging apparatus 100 of FIG. 1), which is configured to generate images using an image file. The image file is analyzed to determine whether the image will only be generated in black. If the image will only be generated using black toner (and not any yellow, cyan or magenta toner), then the color-associated components associated with the colors of yellow, cyan and magenta toner are disengaged and the image is generated. This method is depicted in flowchart 400 of FIG. 7, which can be implemented by the disengage program 170 of FIG. 6, as executed by the processor 156 of FIG. 1. At step S401 of the flowchart 400 the print file (image file) is received into a memory device (such as memory device 158 of FIG. 1). At step S402 the processor (156, FIG. 1) checks to determine whether the print file contains black-only images. If not, then printing continues at step S404, with all rotatable-toner transfer devices engaged. However, if the image is to use only black toner, then at step S408 all of the disengagable non-black toner transfer devices are disengaged, and thereafter the image is printed at step S410. The process ends at step S406. It will be appreciated that the process depicted in flowchart 400 is exemplary only, and that additional steps can be added. Further, while flowchart 400 is particularly directed to printing, it can work equally well for a multi-color photocopier, in which case the "print file" is a scanned image file of the original document which is to be copied.

Figure 8:
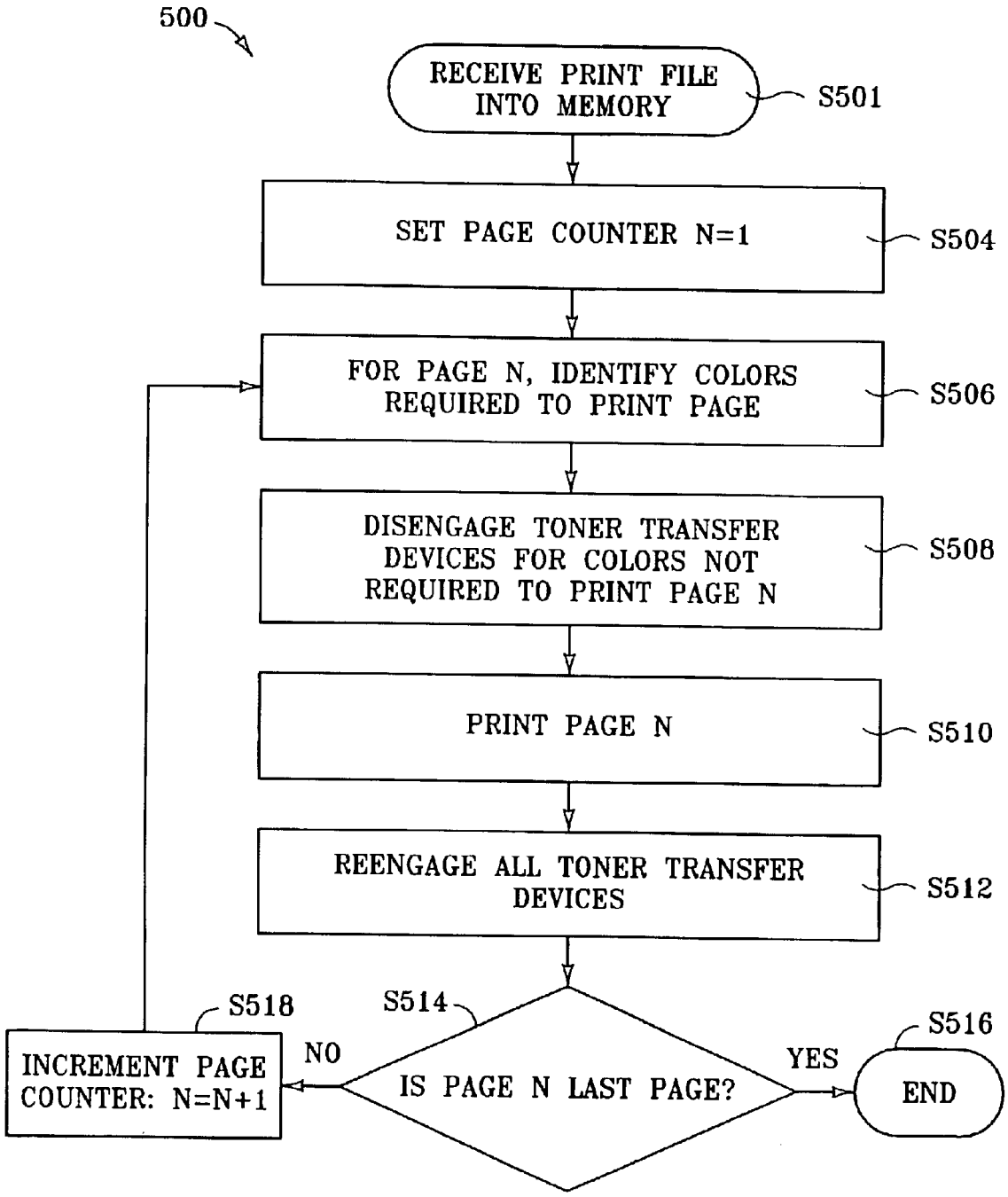
FIG. 8 depicts a flowchart of a second rotatable-toner-transfer-device disengage program that can be used in embodiments of the present invention.

In another variation on the method of the present invention, rather than merely checking to determine whether an image is to be generated using only black toner, the method can include analyzing the image file to determine what colors will be used to generate the image, and then disengaging the color-associated components for only those colors that will not be used to generate the image. For example, if an image is to be generated in black and cyan, then magenta and yellow toners will not be used, and the color-associated components for magenta and yellow can be disengaged. One example of this method is depicted in the flowchart 500 of FIG. 8, which can be implemented by the disengage program 170 of FIG. 6, as executed by the processor 156 of FIG. 1. At step S501 of the flowchart 500 the print file (image file) is received into a memory device (such as memory device 158 of FIG. 1). This method allows the invention to be used for multi-page documents, so at step S504 a page counter is set to page number "N"=1. Then at step S506, for page "N" (here, the first page), the colors required to image that page are identified. Next, at step S508 the toner transfer devices (i.e., selected color-associated components) for the colors which will not be required to image the pages are disengaged. The disengagement can be performed using the disengagement units 200A–200C described above, for example, under control of the processor 156 (FIG. 1). At step S510 page "N" is printed, and then at step S512 the previously-disengaged toner transfer devices are reengaged. The processor checks at step S514 to determine if page "N" was the last page to be imaged and, if so, ends the imaging process at step S516. However, if page "N" was not the last page then at step S518 the page counter is incremented, and the process returns to step S506 to determine what colors are not need to image the then-current page identified by the page counter.

It will be appreciated that the process depicted in flowchart 500 is exemplary only, and that additional, fewer, or different steps can be used. For example, rather than reengaging the previously disengaged components at step S512, the program can first determine what colors will be required to generate the next page. This can reduce unnecessary cycling of the disengage units. Further, while the flowchart 500 is particularly directed to printing, it can work equally well for a multi-color photocopier, in which case the "print file" is a scanned image file of the original document which is to be copied.

While the above invention has been described in language more or less specific as to structural and methodical features, it is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. An imaging apparatus configured to support a rotatable-toner-transfer-device including a toner cartridge and an optical photoconductor, the apparatus comprising a disengagement unit configured to selectively disengage the rotatable-toner-transfer-device dependent on whether the rotatable-toner-transfer-device is required to generate an image, wherein the disengagement unit comprises:

a primary actuator configured to move the optical photoconductor; and, a second actuator configured to move the toner cartridge.

2. The apparatus of claim 1, and further comprising:

a processor and a computer readable memory device; and a rotatable-toner-transfer-device disengage program which is stored in the memory device, and which is executable by the processor to allow the disengagement unit to selectively disengage the rotatable-toner-transfer-device.

3. The apparatus of claim 1, and further comprising a plurality of rotatable-toner-transfer-devices supported within the imaging apparatus.

4. The apparatus of claim 1, and further comprising an intermediate transfer device configured to receive toner from the rotatable-toner-transfer-device, and wherein the disengagement unit is configured to move the rotatable-toner-transfer-device to a position out of contact with the intermediate transfer device.

5. An imaging apparatus configured to support a rotatable-toner-transfer-device having an optical photoconductor, the apparatus comprising:

a disengagement unit configured to selectively disengage the rotatable-toner-transfer-device dependent on whether the rotatable-toner-transfer-device is required to generate an image:

a secondary drive wheel configured to cause the optical photoconductor to rotate, and wherein the disengagement unit comprises a clutch and a clutch actuator configured to engage and disengage the secondary drive wheel;

a spline gear connected to the clutch; and a primary drive wheel configured to drive the secondary drive wheel via the spline gear and the clutch, and wherein the clutch actuator can move the spline gear along the primary drive wheel to thereby disengage the clutch.

6. An imaging apparatus configured to support a rotatable-toner-transfer-device having an optical photoconductor, the imaging apparatus comprising:

a disengagement unit configured to selectively disengage the rotatable-toner-transfer-device dependent on whether the rotatable-toner-transfer-device is required to generate an image;

a primary drive wheel;

a secondary drive wheel configured to cause the optical photoconductor to rotate, and wherein the disengagement unit comprises a clutch and a clutch actuator configured to engage and disengage the secondary drive wheel;

a drive belt engaged by the primary drive wheel and the secondary drive wheel to thereby allow the primary drive wheel to drive the secondary wheel; and a belt-extending roller which allows the effective length of the belt to be increased when the rotatable-toner-transfer-device is disengaged.

7. A system having a plurality of rotatable-toner-transfer-devices, each including an associated optical photoconductor and an associated toner cartridge, the system comprising:

a disengagement unit comprising a primary actuator and a second actuator, wherein the disengagement unit is configured to disengage a selected rotatable-toner-transfer-device by causing the primary actuator to move the associated optical photoconductor and by causing the second actuator to move the toner cartridge;

a processor and a computer readable memory device; and a rotatable-toner-transfer-device disengage program which is stored in the memory device, and which is executable by the processor to allow the disengagement unit to disengage the selected rotatable-toner-transfer-device.

8. The system of claim 7, and wherein:

the imaging apparatus is configured to generate an image on imaging media from an image file, and wherein the image can be imaged using a black toner and a non-black toner;

the rotatable-toner-transfer-device disengage program is configured to analyze the image file and determine if the non-black toner will be used to generate the image, and, when the non-black toner will not be used, to cause the disengagement unit to disengage any rotatable-toner-transfer-device that is associated with non-black toner.

9. The system of claim 7, and further comprising a plurality of disengagement units, and wherein:

the rotatable-toner-transfer-device disengage program is further configured to allow the each of the disengagement units to selectively disengage an associated rotatable-toner-transfer-device.

10. The system of claim 9, and wherein:

the imaging apparatus is configured to generate an image on imaging media from an image file, and wherein the image can be imaged from a plurality of toners, each toner associated with a respective rotatable-toner-transfer-device and a respective disengagement unit; and the rotatable-toner-transfer-device disengage program is further configured to analyze the image file and determine whether a selected toner will be used to generate the image, and, when selected toner will not be used, to cause the respective-disengagement unit to disengage the rotatable-toner-transfer-device which is associated with the selected toner.

11. The system of claim 10, and wherein the plurality of toners include toners of the colors yellow, cyan, magenta and black.

12. The system of claim 10, and wherein the image to be generated comprises a multi-page image, and wherein the rotatable-toner-transfer-device disengage program is further configured to analyze the image file and determine whether a selected toner will not be used to generate a selected page of the image, and, when the selected toner will not be used to generate a selected page of the image, to cause the respective disengagement unit to disengage the rotatable-toner-transfer-device which is associated with the selected toner which will not be used for the selected page.

13. A four-color imaging apparatus configured to generate an image on imaging media and to support a plurality of rotatable-toner-transfer-devices, each rotatable-toner-transfer-device including an associated optical photoconductor and toner cartridge, and each rotatable-toner-transfer-device being associated with one of the four colors, the multi-color imaging apparatus comprising:

a plurality of disengagement units configured to selectively disengage at least three separate color-associated rotatable-toner-transfer-devices, the disengagement being dependent on whether the separate color-associated rotatable-toner-transfer-devices are required to generate the image, and wherein each disengagement unit comprises a primary actuator configured to move the associated optical photoconductor and a second actuator configured to move the associated toner cartridge;

a processor;

a computer readable memory device; and a rotatable-toner-transfer-device disengage program which is stored in the computer-readable memory device, and which is executable by the processor to allow one or more of the disengagement units to selectively disengage selected rotatable-toner-transfer-devices based on whether the selected rotatable-toner-transfer-devices are required to generate an image.

14. The apparatus of claim 13, and further comprising an intermediate transfer device configured to receive color toner from the plurality of color-associated rotatable-toner-transfer-devices, and wherein the primary actuator is configured to move the associated optical photoconductor to a position out of contact with the intermediate transfer device.

15. The apparatus of claim 13, and further comprising a plurality of drive wheels, each drive wheel configured to cause a respective optical photoconductor to rotate, and wherein each disengagement unit comprises a clutch and a clutch actuator configured to engage and disengage the respective drive wheel.

16. An imaging apparatus configured to support a rotatable-toner-transfer-device including a toner cartridge and an optical photoconductor, the apparatus comprising:

a disengagement unit configured to selectively disengage the rotatable-toner-transfer-device dependent on whether the rotatable-toner-transfer-device is required to generate an image, wherein the disengagement unit comprises a primary actuator configured to move the optical photoconductor relative to the toner cartridge.

17. The apparatus of claim 16, and further comprising:

a processor and a computer readable memory device; and a rotatable-toner-transfer-device disengage program which is stored in the memory device, and which is executable by the processor to allow the disengagement unit to selectively disengage the rotatable-toner-transfer-device.

18. The apparatus of claim 16, and further comprising a plurality of rotatable-toner-transfer-devices supported within the imaging apparatus.

19. The apparatus of claim 16, and further comprising an intermediate transfer device configured to receive toner from the rotatable-toner-transfer-device, and wherein the disengagement unit is configured to move the rotatable-toner-transfer-device to a position out of contact with the intermediate transfer device.

20. A system having a plurality of rotatable-toner-transfer-devices, each including an associated optical photoconductor and an associated toner cartridge, the system comprising:

a disengagement unit comprising a primary actuator, wherein the disengagement unit is configured to disengage a selected rotatable-toner-transfer-device by causing the primary actuator to move the associated optical photoconductor relative to the associated toner cartridge;

a processor and a computer readable memory device; and a rotatable-toner-transfer-device disengage program which is stored in the memory device, and which is executable by the processor to allow the disengagement unit to disengage the selected rotatable-toner-transfer-device.

21. The system of claim 20, and wherein:

the imaging apparatus is configured to generate an image on imaging media from an image file, and wherein the image can be imaged using a black toner and a non-black toner; and the rotatable-toner-transfer-device disengage program is configured to analyze the image file and determine if the non-black toner will be used to generate the image, and, when the non-black toner will not be used, to cause the disengagement unit to disengage any rotatable-toner-transfer-device that is associated with non-black toner.

22. The system of claim 20, and further comprising a plurality of disengagement units, wherein the rotatable-toner-transfer-device disengage program is further configured to allow each of the disengagement units to selectively disengage an associated rotatable-toner-transfer-device.

23. The system of claim 22, and wherein:

the imaging apparatus is configured to generate an image on imaging media from an image file, and wherein the image can be imaged using a plurality of toners, each toner associated with a respective rotatable-toner-transfer-device and with a respective disengagement unit; and the rotatable-toner-transfer-device disengage program is further configured to analyze the image file and determine whether a selected toner will be used to generate the image, and, when selected toner will not be used, to cause the respective disengagement unit to disengage the rotatable-toner-transfer-device which is associated with the selected toner.

24. The system of claim 23, and wherein the plurality of toners include toners of the colors yellow, cyan, magenta and black.

25. The system of claim 23, and wherein the image to be generated comprises a multi-page image, and wherein the rotatable-toner-transfer-device disengage program is further configured to analyze the image file and determine whether a selected toner will not be used to generate a selected page of the image, and, when the selected toner will not be used to generate a selected page of the image, to cause the respective disengagement unit to disengage the rotatable-toner-transfer-device which is associated with the selected toner which will not be used for the selected page.

26. A four-color imaging apparatus configured to generate an image on imaging media and to support a plurality of rotatable-toner-transfer-devices, each rotatable-toner-transfer-device including an associated optical photoconductor and toner cartridge, and each rotatable-toner-transfer-device being associated with one of the four colors, the multi-color imaging apparatus comprising:

a plurality of disengagement units configured to selectively disengage at least three separate color-associated rotatable-toner-transfer-devices, the disengagement being dependent on whether the separate color-associated rotatable-toner-transfer-devices are required to generate the image, and wherein each disengagement unit comprises a primary actuator configured to move the associated optical photoconductor relative to the cartridge;

a processor;

a computer readable memory device; and a rotatable-toner-transfer-device disengage program which is stored in the computer-readable memory device, and which is executable by the processor to allow one or more of the disengagement units to selectively disengage selected rotatable-toner-transfer-devices based on whether the selected rotatable-toner-transfer-devices are required to generate an image.

27. The apparatus of claim 26, and further comprising an intermediate transfer device configured to receive color toner from the plurality of color-associated rotatable-toner-transfer-devices, and wherein the primary actuator is configured to move the associated optical photoconductor to a position out of contact with the intermediate transfer device.

28. The apparatus of claim 26, and further comprising a plurality of drive wheels, each drive wheel configured to cause a respective optical photoconductor to rotate, and wherein each disengagement unit comprises a clutch and a clutch actuator configured to engage and disengage the respective drive wheel.

29. A multi-color imaging apparatus configured to support a plurality of color-associated rotatable-toner-transfer-devices, the multi-color imaging apparatus comprising:

a disengagement unit configured to selectively disengage a selected color-associated rotatable-toner-transfer-device dependent on whether the selected color-associated rotatable-toner-transfer-device is required to generate an image;

an intermediate transfer device configured to receive color toner from the plurality of color-associated rotatable-toner-transfer-devices, wherein the disengagement unit comprises a primary actuator configured to move the selected color-associated rotatable-toner-transfer-device to a position out of contact with the intermediate transfer device;

a drive wheel configured to cause a color-associated rotatable-toner-transfer-device to rotate, and wherein the disengagement unit comprises a clutch and a clutch actuator configured to engage and disengage the drive wheel, wherein:

the drive wheel is a secondary drive wheel; and the multi-color imaging apparatus further comprises a spline gear connected to the clutch, and a primary drive wheel configured to drive the secondary drive wheel via the spline gear and the clutch; and, the clutch actuator can move the spline gear along the primary drive wheel to thereby disengage the clutch.

30. A multi-color imaging apparatus configured to support a plurality of color-associated rotatable-toner-transfer-devices, the multi-color imaging apparatus comprising:

a disengagement unit configured to selectively disengage a selected color-associated rotatable-toner-transfer-device dependent on whether the selected color-associated rotatable-toner-transfer-device is required to generate an image;

an intermediate transfer device configured to receive color toner from the plurality of color-associated rotatable-toner-transfer-devices, wherein the disengagement unit comprises a primary actuator configured to move the selected color-associated rotatable-toner-transfer-device to a position out of contact with the intermediate transfer device;

a primary drive wheel;

a secondary drive wheel configured to cause a color-associated rotatable-toner-transfer-device to rotate, and wherein the disengagement unit comprises a clutch and a clutch actuator configured to engage and disengage the drive wheel;

a drive belt engaged by the primary drive wheel and the secondary drive wheel to thereby allow the primary drive wheel to drive the secondary drive wheel; and, a belt-extending roller which allows the effective length of the belt to be increased when the primary actuator moves the selected color-associated rotatable-toner-transfer-device to a position out of contact with the intermediate transfer device.

* * * * *